US008666296B2

(12) United States Patent
Yamamoto et al.

(10) Patent No.: US 8,666,296 B2
(45) Date of Patent: Mar. 4, 2014

(54) MEDIA STRIPPER MECHANISM, FIXING DEVICE, AND IMAGE FORMING APPARATUS

(75) Inventors: Takeshi Yamamoto, Kanagawa (JP); Naoto Suzuki, Kanagawa (JP); Fumihiro Hirose, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 161 days.

(21) Appl. No.: 13/401,173

(22) Filed: Feb. 21, 2012

(65) Prior Publication Data

US 2012/0224893 A1 Sep. 6, 2012

(30) Foreign Application Priority Data

Mar. 1, 2011 (JP) ..... 2011-043764

(51) Int. Cl.
*G03G 15/20* (2006.01)

(52) U.S. Cl.
USPC ..... 399/323

(58) Field of Classification Search
USPC ..... 399/323, 398–399
See application file for complete search history.

(56) References Cited

U.S. PATENT DOCUMENTS

| | | | |
|---|---|---|---|
| 8,023,850 | B2 | 9/2011 | Okamoto et al. |
| 8,027,627 | B2 | 9/2011 | Okamoto et al. |
| 2006/0257183 | A1 | 11/2006 | Ehara et al. |
| 2009/0274477 | A1 | 11/2009 | Okamoto et al. |
| 2009/0274495 | A1 | 11/2009 | Okamoto et al. |
| 2009/0274496 | A1 | 11/2009 | Okamoto et al. |
| 2009/0274497 | A1 | 11/2009 | Okamoto et al. |
| 2009/0297199 | A1 | 12/2009 | Yamashina et al. |
| 2010/0239292 | A1 | 9/2010 | Fujita et al. |
| 2010/0316397 | A1 | 12/2010 | Kudou et al. |
| 2011/0164904 | A1* | 7/2011 | Hirose et al. ..... 399/323 |
| 2011/0182609 | A1 | 7/2011 | Hasegawa et al. |

(Continued)

FOREIGN PATENT DOCUMENTS

| | | |
|---|---|---|
| JP | 51-104350 | 9/1976 |
| JP | 2-218360 | 8/1990 |

(Continued)

OTHER PUBLICATIONS

U.S. Appl. No. 13/205,005, filed Aug. 8, 2011, Fumihiro Hirose, et al.

(Continued)

*Primary Examiner* — G. M. Hyder
(74) *Attorney, Agent, or Firm* — Oblon, Spivak, McClelland, Maier & Neustadt, L.L.P.

(57) ABSTRACT

A media stripper mechanism includes a shaft, one or more first stripping members, and one or more second stripping members. The shaft extends in an axial direction thereof parallel to a rotational axis of the rotary member. Each of the one or more first stripping members is a pneumatic nozzle that has a proximal end thereof supported on the shaft, and a distal, free end opposite the proximal end thereof pointing toward the rotary member to direct compressed gas toward the nip along the rotary member for stripping the recording medium from the rotary member. Each of the one or more second stripping members is a non-contact finger that has a proximal end thereof supported on the shaft, and a distal, free end opposite the proximal end thereof pointing toward the rotary member to assist in stripping the recording medium from the rotary member without contacting the rotary member.

18 Claims, 7 Drawing Sheets

(56) References Cited

U.S. PATENT DOCUMENTS

| | | | | |
|---|---|---|---|---|
| 2011/0206425 | A1 | 8/2011 | Seto et al. | |
| 2011/0217091 | A1* | 9/2011 | Hirose et al. | 399/323 |
| 2011/0305491 | A1 | 12/2011 | Hasegawa et al. | |
| 2012/0014725 | A1 | 1/2012 | Seto et al. | |
| 2012/0044516 | A1* | 2/2012 | Hirose et al. | 358/1.13 |

FOREIGN PATENT DOCUMENTS

| | | |
|---|---|---|
| JP | 3-32878 | 2/1991 |
| JP | 11-334191 | 12/1999 |
| JP | 2004-212954 | 7/2004 |
| JP | 2005-157179 | 6/2005 |
| JP | 2007-187715 | 7/2007 |
| JP | 2007-199462 | 8/2007 |
| JP | 2007-240920 | 9/2007 |
| JP | 2008-102408 | 5/2008 |
| JP | 2009-31759 | 2/2009 |
| JP | 2009-271115 | 11/2009 |

OTHER PUBLICATIONS

U.S. Appl. No. 13/206,966, filed Aug. 10, 2011, Takeshi Yamamoto, et al.

U.S. Appl. No. 13/215,717, filed Aug. 23, 2011, Naoto Suzuki, et al.

* cited by examiner

MEDIA STRIPPER MECHANISM, FIXING DEVICE, AND IMAGE FORMING APPARATUS

CROSS-REFERENCE TO RELATED APPLICATIONS

The present patent application claims priority pursuant to 35 U.S.C. §119 from Japanese Patent Application No. 2011-043764, filed on Mar. 1, 2011, which is hereby incorporated by reference herein in its entirety.

BACKGROUND OF THE INVENTION

1. Technical Field

The present invention relates to a media stripper mechanism, a fixing device, and an image forming apparatus, and more particularly, to a media stripper mechanism for stripping a recording medium from a rotary member, which can be employed in a fixing device that fixes a toner image in place on a recording medium with heat and pressure, and an electrophotographic image forming apparatus, such as a photocopier, facsimile machine, printer, plotter, or multifunctional machine.

2. Background Art

In electrophotographic image forming apparatuses, such as printers and photocopiers, an image is formed by attracting toner particles to a photoconductive surface for subsequent transfer to a recording medium such as a sheet of paper. After transfer, the imaging process is followed by a fixing process using a fixing device, which permanently fixes the toner image in place on the recording medium by melting and settling the toner with heat and pressure.

Various types of fixing devices are known in the art, most of which employ a pair of generally cylindrical looped belts or rollers, one being heated for fusing toner ("fuser member") and the other being pressed against the heated one ("pressure member"), which together form a heated area of contact called a fixing nip through which a recording medium is passed to fix a toner image onto the medium under heat and pressure.

One such fixing device includes a multi-roller, belt-based fuser assembly that employs an endless, flexible fuser belt entrained around multiple rollers, one of which is equipped with an internal heater to heat the length of the fuser belt through contact with the heated roller. Owing to the fuser belt which exhibits a relatively low heat capacity and therefore can be swiftly heated, the belt-based fuser assembly allows for shorter start-up time and smaller amounts of energy wasted during standby, as well as a relatively compact size of the fuser assembly.

One important factor that determines imaging quality of a fixing device is the ability to properly convey a recording medium through the fixing nip without causing the recording medium to wind or wrap around the rotary fixing member. Media wraparound occurs where the toner image heated through the fixing nip becomes sticky and thus adheres to the surface of the fixing member upon exiting the fixing nip. If not corrected, a recording medium wrapping around the fixing member would cause jam or other conveyance failure in the fixing nip.

For obtaining a fixing process with high immunity against media wraparound and concomitant conveyance failure, a fixing device may use a fuser roller or belt coated with a release agent such as fluorine resin where it contacts a heated, sticky toner image in the fixing nip, while equipped with a media stripping member in the shape of a claw which is held in contact with the fuser member to separate a recording medium from the fuser member at the exit of the fixing nip. Use of the media stripping claw, however, can cause image defects depending on a specific application of the fixing device.

For example, for monochrome printing applications, a hard fuser roller is used that comprises a cylindrical body of metal coated with polytetrafluoroethylene (PTFE) commercially available under the trademark Teflon®. The metallic fuser roller is durable and highly immune to abrasion or other damage caused by continuous contact with the media stripping claw. For multi-color printing applications, on the other hand, a fuser roller is covered with an outer elastic layer of fluorine-coated silicone rubber, such as a several tens micron-thick tubular coating of perfluoroalkoxy, or with a coating of oil or fluorine resin deposited on the silicone rubber layer. The rubber-covered roller allows for good reproduction of color, while relatively vulnerable to damage as the outer elastic layer readily abrades due to continuous contact with the media stripping claw, resulting in undesired streaks or other imperfections in a resulting image.

A practical approach to prevent damage to the fuser member and concomitant image defects is to use a non-contact media stripper mechanism that can strip a recording medium without touching the fuser member. One example of such non-contact media stripper is an elongated mechanical assembly, such as a thin-edged stripping plate or a plurality of interspaced stripping fingers arranged in line, which extends parallel to a length of the fuser member with a spacing of approximately 0.2 mm to approximately 1.0 mm left between the stripping member and the fuser member. Another example is a self-stripping system in which a recording medium separates from an elastic curved surface of a fixing member due to its own stiffness and the elasticity of the fixing member.

Although effective for their intended purposes, the non-contact stripping methods depicted above would not work properly, where the recording medium exhibits a greater than usual tendency to adhere to the fixing member and escape the stripping member to enter a space between the fixing member and the adjoining guide structure, such as in the case of processing thin paper, a densely printed page with a narrow margin on the leading edge, or a solid or photographic print. Such failure in stripping the recording medium from the fixing member eventually cause the recording medium to wrap around the fuser member, or otherwise to unduly interfere with the media stripper, resulting in paper jam and other concomitant conveyance failure in the fixing nip.

To promote better functioning of a non-contact media stripper, several methods have been proposed which employ a pneumatic nozzle in combination with a mechanical stripping member. Upon activation, the pneumatic nozzle directs compressed air to an interface between a fuser member and a printed face of a recording medium, so as to pneumatically force the recording medium to separate from the fuser member at the exit of a fixing nip. In a sophisticated, power-efficient configuration, such a pneumatic nozzle is activated only temporarily where the leading edge of a recording medium exits the fixing nip, which reduces the load and size of an air compressor required to operate the pneumatic stripper mechanism.

SUMMARY OF THE INVENTION

Exemplary aspects of the present invention are put forward in view of the above-described circumstances, and provide a novel media stripper mechanism for use with a pair of opposed rotary members disposed opposite each other to form a nip therebetween through which a recording medium is conveyed as the rotary members rotate together.

In one exemplary embodiment, the novel media stripper mechanism includes a shaft, one or more first stripping members, and one or more second stripping members. The shaft extends in an axial direction thereof parallel to a rotational axis of the rotary member. Each of the one or more first stripping members is a pneumatic nozzle that has a proximal end thereof supported on the shaft, and a distal, free end opposite the proximal end thereof pointing toward the rotary member to direct compressed gas toward the nip along the rotary member for stripping the recording medium from the rotary member. Each of the one or more second stripping members is a non-contact finger that has a proximal end thereof supported on the shaft, and a distal, free end opposite the proximal end thereof pointing toward the rotary member to assist in stripping the recording medium from the rotary member without contacting the rotary member. The distal ends of the nozzle and the finger are coincident with each other in shape and position when viewed in the axial direction of the shaft.

Other exemplary aspects of the present invention are put forward in view of the above-described circumstances, and provide a novel fixing device.

In one exemplary embodiment, the novel fixing device includes a pair of opposed rotary fixing members and a media stripper mechanism. The pair of opposed rotary fixing members is disposed opposite each other to form a fixing nip therebetween through which a recording medium is conveyed as the rotary members rotate together. The media stripper mechanism is disposed downstream from the fixing nip to strip the recording medium exiting the fixing nip. The media stripper mechanism includes a shaft, one or more first stripping members, and one or more second stripping members. The shaft extends in an axial direction thereof parallel to a rotational axis of the rotary member. Each of the one or more first stripping members is a pneumatic nozzle that has a proximal end thereof supported on the shaft, and a distal, free end opposite the proximal end thereof pointing toward the rotary member to direct compressed gas toward the nip along the rotary member for stripping the recording medium from the rotary member. Each of the one or more second stripping members is a non-contact finger that has a proximal end thereof supported on the shaft, and a distal, free end opposite the proximal end thereof pointing toward the rotary member to assist in stripping the recording medium from the rotary member without contacting the rotary member. The distal ends of the nozzle and the finger are coincident with each other in shape and position when viewed in the axial direction of the shaft.

Still other exemplary aspects of the present invention are put forward in view of the above-described circumstances, and provide an image forming apparatus.

In one exemplary embodiment, the novel image forming apparatus includes a pair of opposed rotary members, a shaft, one or more first stripping members, and one or more second stripping members. The pair of opposed rotary members is disposed opposite each other to form a nip therebetween through which a recording medium is conveyed as the rotary members rotate together. The shaft extends in an axial direction thereof parallel to a rotational axis of the rotary member. Each of the one or more first stripping members is a pneumatic nozzle that has a proximal end thereof supported on the shaft, and a distal, free end opposite the proximal end thereof pointing toward the rotary member to direct compressed gas toward the nip along the rotary member for stripping the recording medium from the rotary member. Each of the one or more second stripping members is a non-contact finger that has a proximal end thereof supported on the shaft, and a distal, free end opposite the proximal end thereof pointing toward the rotary member to assist in stripping the recording medium from the rotary member without contacting the rotary member. The distal ends of the nozzle and the finger are coincident with each other in shape and position when viewed in the axial direction of the shaft.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
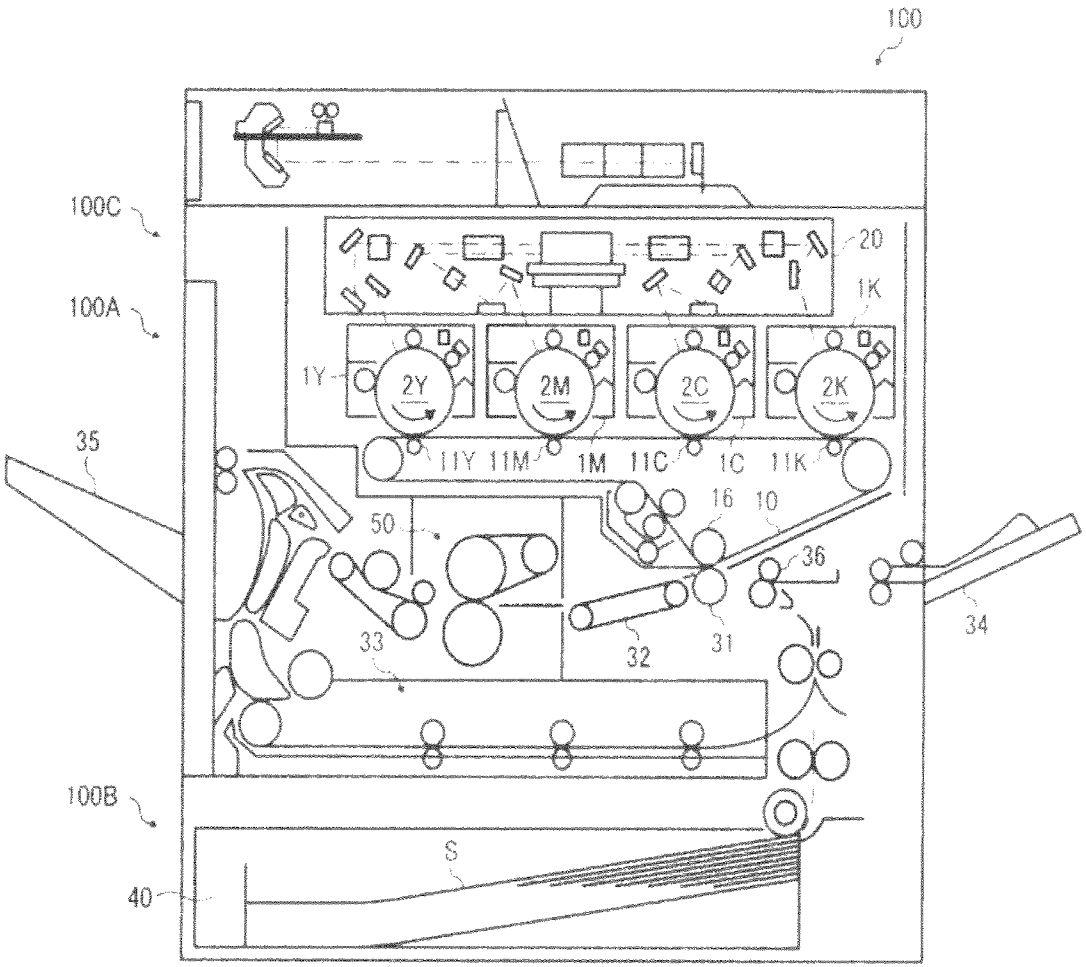
FIG. 1 schematically illustrates an image forming apparatus according to one embodiment of this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 100 according to one embodiment of this patent specification.

As shown in FIG. 1, the image forming apparatus 100 is a digital color imaging system that can print a color image on a recording medium such as a sheet of paper S according to image data, consisting of a generally upper, printer section 100A, and a generally lower, sheet feeding section 100B combined together to form a freestanding unit, on top of which may be deployed an appropriate image scanner 100C, that allows for capturing image data from an original document.

The printer section 100A comprises a tandem color printer that forms a color image by combining images of yellow, magenta, and cyan (i.e., the complements of three subtractive primary colors) as well as black, consisting of four electrophotographic imaging stations 1Y, 1M, 1C, and 1K arranged in series substantially laterally along the length of an intermediate transfer belt 10, each forming an image with toner particles of a particular primary color, as designated by the suffixes "Y" for yellow, "M" for magenta, "C" for cyan, and "K" for black.

Each imaging station 1 includes a drum-shaped photoconductor 2 rotatable counterclockwise in the drawing, having its outer, photoconductive surface exposed to an exposure device 20 while surrounded by various pieces of imaging equipment, such as a charging device, a development device accommodating toner of the associated primary color, a primary transfer device incorporating an electrically biased, primary transfer roller 11, a cleaning device for the photoconductive surface, etc., which work in cooperation to form a primary toner image on the photoconductor 2 for subsequent transfer to the intermediate transfer belt 10 at a primary transfer nip defined between the photoconductive drum 2 and the primary transfer roller 11.

The intermediate transfer belt 10 is trained around multiple support rollers to rotate clockwise in the drawing, passing through the four primary transfer nips sequentially to carry thereon a multi-color toner image toward a secondary transfer nip defined between a secondary transfer roller 31 and a backup roller 16, at which the toner image is transferred to a recording sheet S fed from the sheet feeding section 100B.

The sheet feeding section 100B includes one or more sheet trays 40 each accommodating a stock of recording sheets S, as well as a sheet conveyance mechanism, including multiple rollers, guide plates, etc., which together define a sheet conveyance path for conveying a recording sheet S from the sheet tray 40 or a manual input sheet tray 34, between a pair of registration rollers 36, then through the secondary transfer nip, and then through a fixing device 50 which fixes the toner image in place on the recording sheet S with heat and pressure. A detailed description of the fixing device 50 and its associated structure will be given later with reference to FIG. 2 and subsequent drawings.

Downstream of the fixing device 50 along the sheet conveyance path is a sheet reversing unit 33 that reverses the recording sheet S after fixing to reintroduce it into the sheet conveyance path where required, as well as an output sheet tray 35 disposed outside the apparatus body to accommodate a finalized print for user pickup.

During operation, each imaging station 1 rotates the photoconductor drum 2 clockwise in the drawing to forward its photoconductive surface to a series of electrophotographic processes, including charging, exposure, development, transfer, and cleaning, in one rotation of the photoconductor drum 2.

First, the photoconductive surface is uniformly charged to a specific polarity by the charging device and subsequently exposed to a modulated laser beam emitted from the exposure device 20. The laser exposure selectively dissipates the charge on the photoconductive surface to form an electrostatic latent image thereon according to image data representing a particular primary color. Then, the latent image enters the development device which renders the incoming image visible using toner. The toner image thus obtained is forwarded to the primary transfer device that electrostatically transfers the primary toner image to the intermediate transfer belt 10 through the primary transfer nip.

Such imaging operation may be performed without employing all the four imaging stations 1Y, 1M, 1C, and 1K. For example, a monochrome image of a particular primary color is formed with only a single imaging station 1 dedicated to the specific primary color, whereas a bi-color or tri-color image is formed with selected two or three imaging stations. In particular, a black-and-white image may be formed with only the black imaging station 1K instead of activating all the four imaging stations.

As the multiple imaging stations 1 sequentially produce toner images of different colors at the four transfer nips along the belt travel path, the primary toner images are superimposed one atop another to form a single multicolor image on the moving surface of the intermediate transfer belt 10 for subsequent entry to the secondary transfer nip between the secondary transfer roller 31 and the backup roller 16.

Meanwhile, the sheet conveyance mechanism picks up a recording sheet S from atop the sheet stack in the sheet tray 40 or the manual input tray 34 to introduce it between the pair of registration rollers 36 being rotated. Upon receiving the incoming sheet S, the registration rollers 36 stop rotation to hold the sheet S therebetween, and then advance it in sync with the movement of the intermediate transfer belt 10 to the secondary transfer nip.

At the secondary transfer nip, the multicolor image is transferred from the belt 10 to the recording sheet S, which is then introduced into the fixing device 50 to fix the toner image in place under heat and pressure. The recording sheet S, thus having its first side printed, is forwarded to a sheet diverter that selectively directs the incoming sheet S to the output sheet tray 35 where simplex printing is intended, or to the sheet reversing unit 33 where duplex printing is intended.

For duplex printing, the sheet reversing unit 33 turns over the incoming sheet S for reentry to the sheet conveyance path, wherein the reversed sheet S again undergoes electrophotographic imaging processes including registration through the registration roller pair 36, secondary transfer through the secondary transfer nip, and fixing through the fixing device 50 to form another print on its second side opposite the first side.

Upon completion of simplex or duplex printing, the recording sheet S is output to the output sheet tray 35 for stacking outside the apparatus body, which completes one operational cycle of the image forming apparatus 100.

Figure 2:
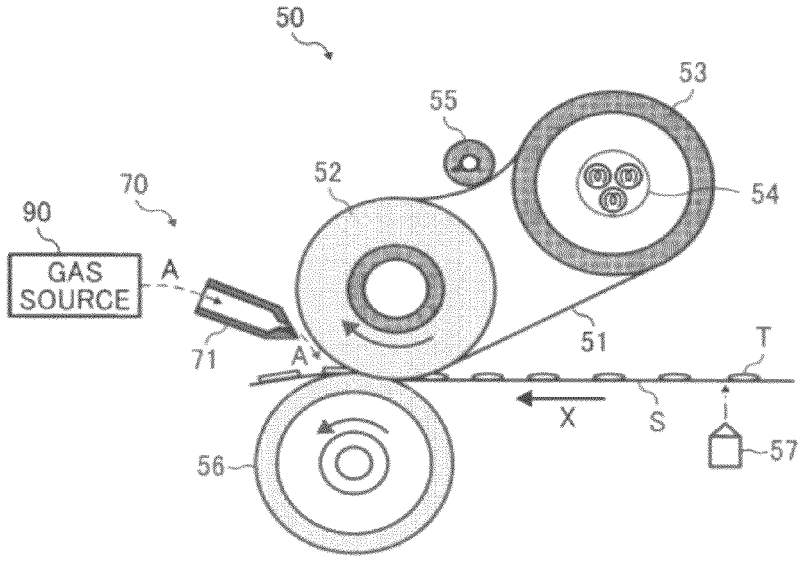
FIG. 2 is an end-on, axial cutaway view schematically illustrating a fixing device according to one embodiment of this patent specification.

FIG. 2 is an end-on, axial cutaway view schematically illustrating the fixing device 50 according to one embodiment of this patent specification.

As shown in FIG. 2, the fixing device 50 includes a rotary fuser belt 51 entrained around a driver, fuser roller 52 and an idler, heat roller 53, as well as a rotary pressure roller 56 pressed against the fuser roller 52 through the fuser belt 51 to form a fixing nip N therebetween, all of which extend in an axial, longitudinal direction perpendicular to the sheet of paper on which the FIG. is drawn.

In the present embodiment, the fuser belt 51 comprises a rotatable endless belt looped for rotation around the multiple rotatable rollers 52 and 53. A tension roller 55 is held against the belt 51 outside the belt loop to impart proper tension to the belt 51 between the belt supporting rollers 52 and 53. Alternatively, the tension roller 55 may be disposed inside the belt loop depending on the specific configuration.

The fuser roller 52 comprises a motor-driven rotatable cylinder, consisting of a cylindrical core of metal covered by an elastic layer of silicone rubber or the like deposited thereupon, with a rotary motor connected to the metal core to impart rotation to the cylindrical body.

The heat roller 53 comprises a hollow, rotatable cylinder of thermally conductive material, which accommodates an internal heater 54, such as a halogen lamp, in its hollow interior to supply heat to the fuser assembly. Heating the fuser assembly may be performed with any suitable heating device, such as a halogen heater or an electromagnetic induction heater, depending on the specific configuration.

Operation of the heater 54 is controlled according to readings of a thermometer or thermistor disposed adjacent to the heat roller 53 to detect temperature of the fuser belt 51, so as to heat the belt 51 properly, for example, to a temperature suitable for fusing toner in use. For efficient control of the heating temperature and other operational parameters of the fixing device, a sensor 57 may be provided adjacent to an entry to the fixing device to detect a recording medium S passing upstream from the fixing nip N.

The pressure roller 56 comprises a cylindrical roller consisting of a rotatable cylinder covered by an elastic layer of silicone rubber or the like deposited thereupon, equipped with a suitable biasing mechanism that presses the pressure roller 56 against the fuser roller 52. Optionally, the pressure roller 56 may have a dedicated internal heater accommodated in its hollow interior.

Although the present embodiment depicts an endless fuser belt entrained around multiple rollers, alternatively, instead, the rotary fuser member 51 may be configured as any suitable rotatable member, such as an internally heated, hollow cylindrical roller, or a looped piece of thin film rotatable around a heated roll or pipe. Also, although the present embodiment depicts a hollow cylindrical pressure roller, alternatively, instead, the rotary pressure member 56 may be configured as an endless looped belt or other suitable rotatable member. Further, although the present embodiment depicts a motor-driven fuser roller to drive the rotary fixing members, alternatively, a rotary motor may be provided to a pressure roller, a heat roller, or other suitable portion of the fixing assembly.

During operation, the fuser roller 52 rotates in a given direction of rotation (i.e., clockwise in FIG. 2) to rotate the fuser belt 51 in the same rotational direction, which in turn rotates the pressure roller 56 held in contact with the rotating belt 51. The fuser belt 51 during rotation is kept in proper tension with the tension roller 55 pressing against the belt 51 from outside of the belt loop, while having its circumference heated with the heat roller 53 to a given processing temperature sufficient for fusing toner at the fixing nip N.

In this state, a recording sheet S bearing an unfixed, powder toner image T enters the fixing device 50, with its previously imaged side facing the fuser belt 51 and opposite side brought into contact with the pressure roller 56. As the rotary fixing members 51 and 56 rotate together, the recording sheet S proceeds in a sheet conveyance direction X to pass through the fixing nip N, wherein heat from the fuser belt 51 causes toner particles to fuse and melt, while pressure from the pressure roller 56 causes the molten toner to settle onto the sheet surface, thereby fixing the toner image in place on the recording sheet S.

With continued reference to FIG. 2, the fixing device 50 is shown provided with a sheet stripper mechanism 70 disposed downstream from the fixing nip N in the sheet conveyance direction X. The sheet stripper mechanism 70 includes a combination of a first, pneumatic stripper 71 and a second, mechanical stripper 72, the former being shown only partially and the latter being invisible in FIG. 2, which extends parallel to, and slightly spaced away from, the fuser belt 51 to strip a recording sheet S from the fuser belt 51 upon exiting the fixing nip N.

Figure 3:
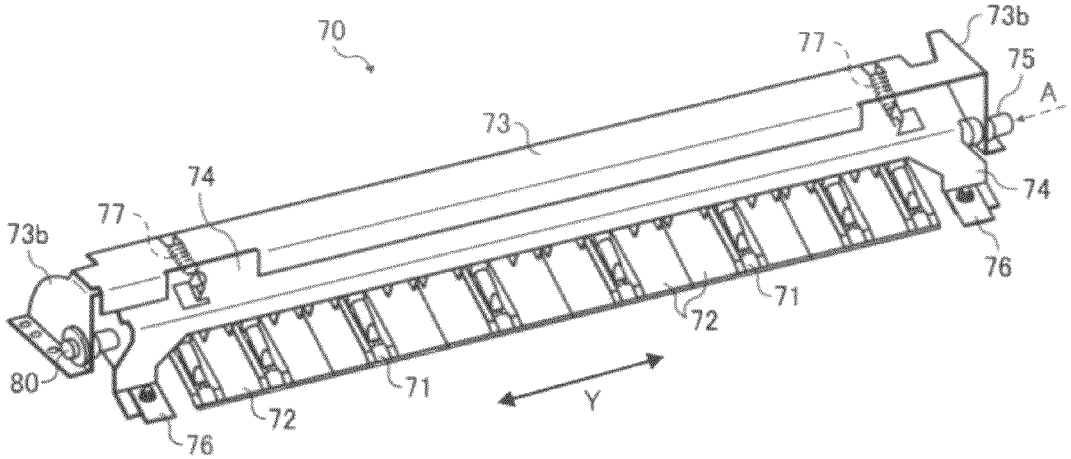
FIG. 3 is a perspective view of a media stripper mechanism for use in the fixing device of FIG. 2.

Specifically, with additional reference to FIG. 3, which is a perspective view of the sheet stripper mechanism 70, the sheet stripper mechanism 70 includes an elongated shaft 75 extending in an axial, longitudinal direction thereof Y parallel to a rotational axis of the fuser belt 51 rotating around the fuser roller 52, on which the first and second strippers 71 and 72 are supported. The first stripper 71 includes one or more first stripping members or pneumatic nozzles each of which has a proximal end thereof supported on the shaft 75, and a distal, free end opposite the proximal end thereof pointing toward the fuser belt 51. The second stripper 72 includes one or more second stripping members or non-contact fingers each of which has a proximal end thereof supported on the shaft 75, and a distal, free end opposite the proximal end thereof pointing toward the fuser belt 51.

More specifically, in the present embodiment, the nozzles 71 and the fingers 72 are generally symmetrically arranged along a length of the shaft 75, with each nozzle 71 separated from another nozzle 71 by one or more fingers 72. For example, the sheet stripper mechanism 70 may have a total of eight nozzles 71 combined with a total of twelve fingers 72, wherein each nozzle 71 is separated from each other nozzle 71 by two consecutive fingers 72, except for the two nozzles 71 at each end in the longitudinal direction which have only a single finger 72 interposed therebetween. In case only a single nozzle 71 is provided, such a nozzle 71 may be situated at a substantial center of the shaft 75 in the longitudinal direction of the fuser roller 52.

The overall structure of the sheet stripper mechanism 70 may be constructed on an elongated frame 73 which is affixed to an enclosure housing of the fixing device 50 upon assembly. The frame 73 has its opposed longitudinal ends bent substantially perpendicularly to form a pair of parallel sidewalls 73*b*, on which the opposed longitudinal ends of the shaft 75 are rotatably supported via bearings.

During operation, an external compressed gas source 90, for example, an air pump or compressor combined with an air tank and an electromagnetic valve, supplies a regulated flow of compressed gas or air A to the pneumatic nozzles 71 via a suitable conduit, which then direct compressed gas A toward the fixing nip N as the leading edge of a recording sheet S reaches the fixing nip N. The blow of compressed gas A thus discharged forces the leading edge of the recording sheet S to separate from the fuser belt 51, thereby enabling subsequent, ready separation of the printed surface of the sheet S from the fuser belt 51. Activation of the pneumatic stripper 71 may take place whenever a single recording sheet S passes through the fixing nip N during sequential processing of multiple recording sheets S. Such stripping of the recording sheet S from the fuser belt 51 is assisted by the non-contact fingers 72 placed adjacent to the pneumatic nozzles 71 without contacting the fuser belt 51.

As used herein, the term "recording medium" is used to describe any material, such as a sheet of paper, subjected to imaging process including passage through a nip defined between a pair of opposed rotary members disposed opposite each other. The term "rotary member" refers to a rotatable, generally tubular or cylindrical body, such as a belt, roller, or the like, which is paired with another rotary member to define a nip therebetween. Also, the term "stripping" is used to describe removal of a recording medium from a rotary member, and the term "stripper" or "stripping member" refers to any device, either pneumatic or mechanical, that strips or assists in stripping a recording medium from the rotary member, including not only a pneumatic nozzle but also a mechanical, finger-like structure, such as wedge, blade, plate, or the like, positioned away from direct contact with the surface of the rotary member.

Figure 4:
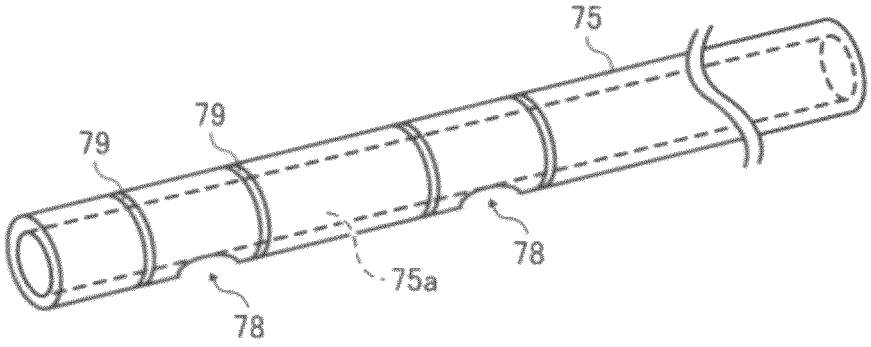
FIG. 4 is a partial perspective view of a shaft before assembly into the media stripper mechanism of FIG. 3.

FIG. 4 is a partial perspective view of the shaft 75 before assembly into the sheet stripper mechanism 70.

As shown in FIG. 4, the shaft 75 comprises a hollow, perforated, elongated open-ended tube (hereinafter also referred to as "manifold 75"), defining a duct 75*a* for conducting compressed gas therethrough. One or more holes or perforations 78 are provided in the duct 75*a*, the number of which is equal to the number of nozzles 71 provided in the sheet stripper mechanism 70, each for establishing fluid communication with an associated one of the nozzles 71. A pair of exterior annular grooves 79 is cut on opposite sides of each perforation 78 for receiving O-rings for sealing the duct 75*a* against leakage of compressed gas.

The manifold 75 may be formed of suitable corrosion-resistant metal, such as stainless steel, aluminum alloy or the like. For protection against corrosion in the inevitable presence of drain water originating from compressed gas flowing therethrough, the manifold 75 may have its exposed surfaces formed of corrosion-resistant material or protected against corrosion. In particular, where the manifold 75 is formed of sulfur-based free-machinable steel, suitable anti-corrosive plating may be provided to at least the inner wall of the tube.

With additional reference to FIG. 3, when assembled, the manifold 75 has one longitudinal end connected to the external compressed gas source 90 from which compressed gas A is conducted to the manifold 75 for supply to the respective nozzles 71. The other, opposite longitudinal end of the manifold 75 is sealed with a screw 80 plugged into the tubular body. For good sealing against air and moisture, the manifold 75 may be provided a suitable sealant around the screw 80, such as a thin wrapping of PTFE, or a deposition of suitable additive. Instead of plugging with the screw 80, sealing the manifold 75 may also be accomplished by closing the open end through welding or adhesive seal.

Figure 5:
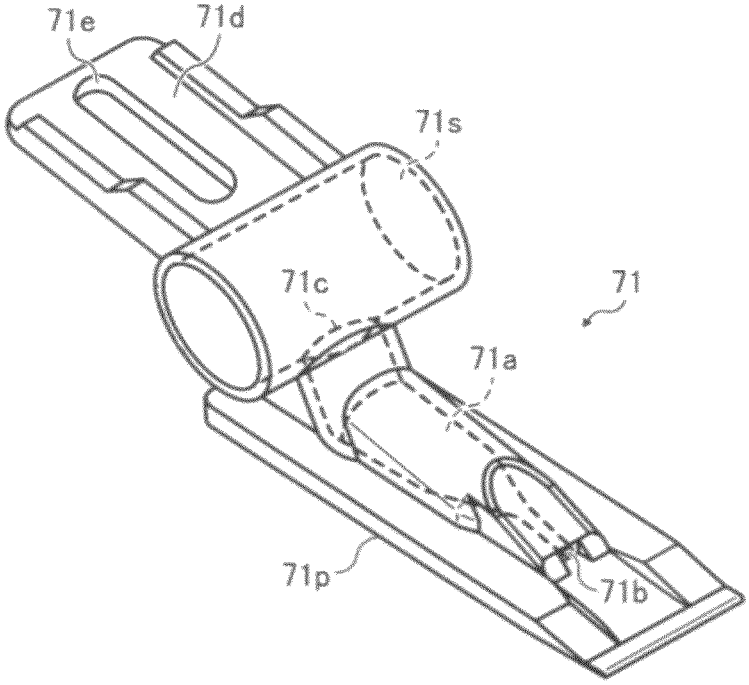
FIG. 5 is a perspective view of a pneumatic nozzle before assembly into the media stripper mechanism of FIG. 3.

FIG. 5 is a perspective view of the pneumatic nozzle 71 before assembly into the sheet stripper mechanism 70.

As shown in FIG. 5, the pneumatic nozzle 71 includes a tubular, mounting sleeve 71*s* through which the manifold 75 is inserted during assembly, and a nozzle body defining a generally tapered channel 71*a* with an outlet opening 71*b* at its narrower end for discharging compressed gas to outside, and an inlet opening 71*c* at its wider end which is open to the sleeve 71*s* for introducing compressed gas into the channel 71*a*, all of which are deployed atop a planar base 71*p* defining a surface that faces the sheet conveyance path upon installation in the fixing device 50. An adjustment flap 71*d*, with an oval slot 71*e* defined therein, extends from the sleeve 71*s* opposite the nozzle body for allowing positioning of the nozzle 71 around the manifold 75.

The pneumatic nozzle 71 may be formed of thermally stable resins, such as polyphenylene sulfide (PPS), polyether ether ketone (PEEK), polyethylene terephthalate (PET), and polyether sulfone (PES). For obtaining protection against adhesion of toner, it is possible to form the nozzle 71 of low-friction material, such as perfluoroalkoxy (PFA), and/or to provide a coating of anti-stick material, such as polyester amide (PEA) or polytetrafluoroethylene (PTFE), selectively to the distal end of the nozzle 71 which is most prone to contamination with toner adherents. The distal end of the nozzle 71 may be integrally formed with the base 71*p* into a single integrated piece through outsert-molding of suitable material, such as PFA or the like.

The outlet opening 71*b* of the nozzle 71 may be shaped, for example, in a rectangular configuration with a length and width ranging from approximately 0.5 mm to approximately 2.0 mm, or a circular configuration with a diameter ranging from approximately 0.5 mm to approximately 2.0 mm, yielding a cross-sectional area ranging from a minimum of approximately 0.19 $mm^2$ to a maximum of approximately 4.0 $mm^2$.

Figure 6:
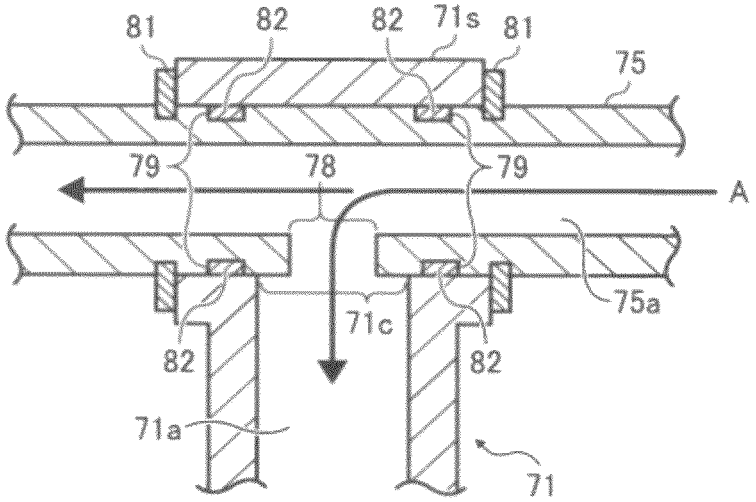
FIG. 6 is a partial cross-sectional view of the pneumatic nozzle and the shaft assembled in operational position.

FIG. 6 is a partial cross-sectional view of the pneumatic nozzle 71 and the manifold 75 assembled in operational position.

As shown in FIG. 6, upon assembly, the pneumatic nozzle 71 is rotatably mounted on the manifold 75 by fitting the mounting sleeve 71*s* around the manifold 75. Before fitting the nozzle 71 around the manifold 75, a pair of O-rings 82 may be provided in the exterior annular grooves 79 of the manifold 75 to prevent leakage of fluid at the interface between the channel 71*a* and the duct 75*a*. Also, after mounting the nozzle 71, a pair of E-rings 81 may be provided around the manifold 75 at opposed sides of the sleeve 71*s* to retain the nozzle 71 in position in the axial direction of the manifold 75. Where the nozzle 71 is in proper operational position, the inlet opening 71*c* aligns with the perforation 78 to establish a fluid communication therebetween, through which a supply of compressed gas A flows from the duct 75*a* into the channel 71*a* for subsequent discharging from the outlet opening 71*b*.

Figure 7:
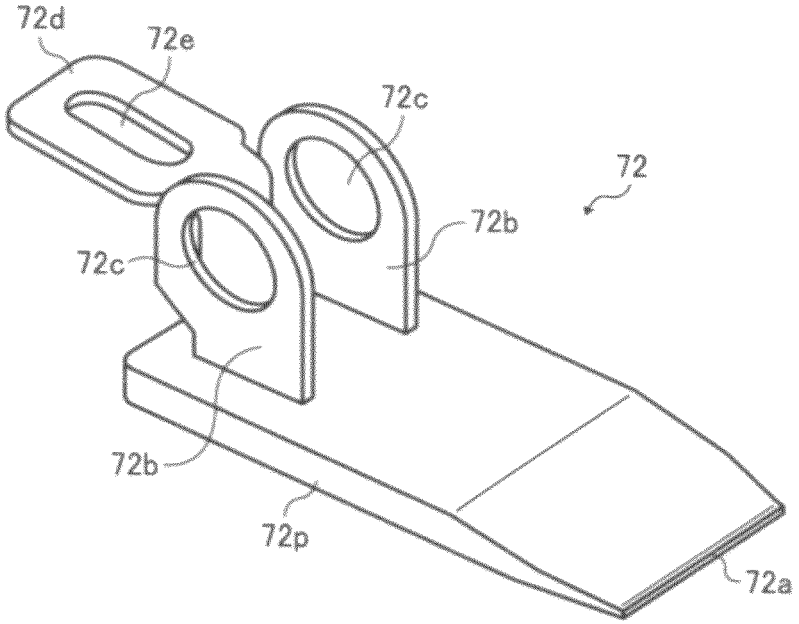
FIG. 7 is a perspective view of a non-contact finger before assembly into the media stripper mechanism of FIG. 3.

FIG. 7 is a perspective view of the non-contact finger 72 before assembly into the sheet stripper mechanism 70.

As shown in FIG. 7, the non-contact finger 72 includes a planar base 72*p* defining a surface that faces the sheet conveyance path upon installation in the fixing device 50. A thin, wedged, separator edge 72*a* is provided at a distal, free end of the base 72*p* for directing a recording sheet S to position in the sheet conveyance path. From the base 72*p* extends a pair of perpendicular, parallel mounting tabs 72*b* each defining a slot 72*c* through which the manifold 75 is inserted during assembly. An adjustment flap 72*d*, with an oval slot 72*e* defined therein, extends from the base 72*p* opposite the edge 72*a* for allowing positioning of the finger 72 around the manifold 75.

Similar to the pneumatic nozzle 71, the non-contact finger 72 may be formed of thermally stable resins, such as polyphenylene sulfide (PPS), polyether ether ketone (PEEK), polyethylene terephthalate (PET), and polyether sulfone (PES), with a coating of anti-stick material, such as polyester amide (PEA) or polytetrafluoroethylene (PTFE), provided to the entire surface or selectively to the distal end of the finger 72 which is most prone to contamination with toner adherents.

The distal end of the finger 72 may be integrally formed with the base 72*p* into a single integrated piece through outsert- or insert-molding of suitable material, such as PFA or the like. Alternatively, instead of outsert- or insert-molding of different materials, the base 72*p* and the distal end of the finger 72 may be formed through molding of a single, identical material. Integrally forming the discrete parts of finger 72 through outsert- or insert-molding allows for precise positioning of the separator edge 72*a* relative to the base tabs 72*c* defining a rotational axis of the finger 72.

Also, as is the case with the pneumatic nozzle 71, the non-contact finger 72 is rotatably mounted on the manifold 75 by fitting the pair of mounting tabs 72*c* around the manifold 75. After mounting the finer 72, a pair of E-rings may be provided around the manifold 75 adjacent to the tabs 72*c* to retain the finger 72 in position in the axial direction of the manifold 75.

Referring back to FIG. 3, the sheet stripper mechanism 70 is shown further including an elongated stay 74 combined with a pair of flanges 76 and a biasing member 77, which together form a positioning mechanism to maintain the stripping members 71 and 72 in position spaced away from the fuser member 51.

Specifically, in the present embodiment, the elongated stay 74 is rotatably connected to the stationary frame 73 by having its sidewalls connected to the rotatable shaft 75. The stay 74 and the shaft 75 are positioned stationary with respect to each other, for example, by providing a through-hole of a radially asymmetrical cross-section, e.g., a flattened or D-shaped cross-section, in at least one of the sidewalls of the stay 74 through which the shaft 75 is inserted to restrict movement of the stay 74 relative to the shaft 75.

The pair of flanges 76 is disposed at opposed longitudinal ends of the stay 74 to contact the fuser belt 51 outboard of a width of recording sheet S, in particular, a maximum compatible sheet width that the fixing device 50 can accommodate through the sheet conveyance path. The biasing member 77 comprises a tension spring disposed between the stay 74 and the frame 73 to elastically bias the stay 74 in a predetermined rotational direction around the shaft 75.

Figure 8:
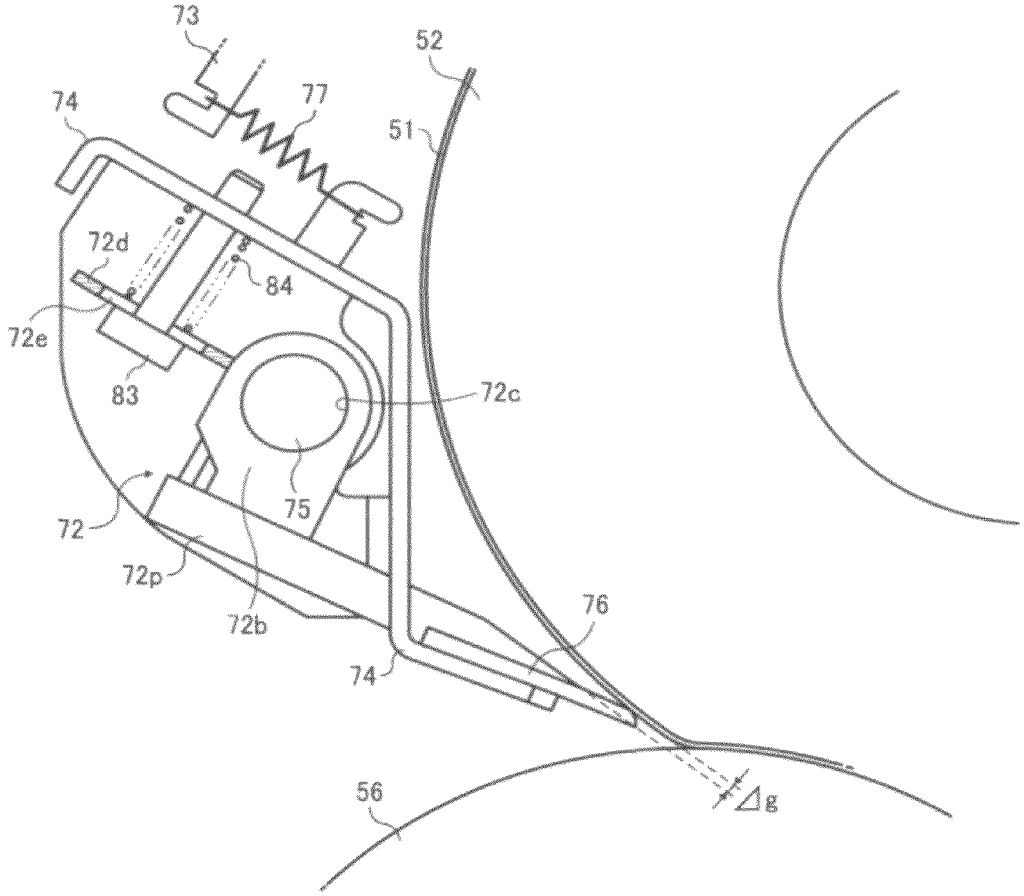
FIG. 8 is an enlarged, partial cross-sectional view of the media stripper mechanism of FIG. 3.

With additional reference to FIG. 8, which is an enlarged, partial cross-sectional view of the sheet stripper mechanism 70, the tension spring 77 is shown between the stay 74 and the frame 73 to elastically bias the stay 74 to rotate against the fuser assembly (i.e., counterclockwise in FIG. 8) around the shaft 75, which in turn forces the pair of flanges 76 against the fuser roller 52 through the fuser belt 51.

During operation, as the rotating fuser roller 52 wobbles and vibrates in contact with the flanges 76, such wobbling or vibratory rotation of the roller 52 translates into oscillations of the flanges 76 at a constant period equal to a rotational period of the roller 52, which eventually causes the stay 74 to periodically swivel around the shaft 75 at the same rotational period of the roller 52. This synchronous, periodic motion of the stay 74 with the fuser roller 52 eventually maintains the distal ends of the stripping members 71 and 72 at a substantially constant, uniform distance or gap Δg from the fuser belt 51.

Provision of the positioning mechanism thus allows for precise positioning of the stripping members 71 and 72 connected thereto via the shaft 75, which allows the sheet stripper mechanism 70 to stabilize the direction of compressed gas toward the fuser belt 51, while preventing paper jam or other conveyance failures caused where the leading edge of a recording sheet enters an enlarged space between the stripping member and the fuser belt 51. Moreover, owing to the flanges 76 disposed outboard of a width of recording sheet S in the sheet conveyance path, the positioning mechanism works without directly contacting, and therefore without scratching or otherwise damaging, the fuser belt 51 where it conveys the recording sheet S thereon.

With continued reference to FIG. 8, the sheet stripper mechanism 70 is shown further including a gap adjuster member 83 disposed between the stripping member 72 and the stay 74 to adjust the width of the spacing or gap Δg between the distal end of the stripping member 72 and the fuser belt 51.

Specifically, in the present embodiment, the gap adjuster member 83 includes a spring-loaded screw that has its proximal end inserted loosely through the slot 72*e* in the adjustment tab 72*d* of the stripper finger 72, and its distal end screwed into the stay 72. A compression spring 84 is provided around the screw shank between the stay 74 and the finger tab 72*d*, so as to elastically bias the finger tab 72*d* away from the stay 72 (i.e., counterclockwise in FIG. 8) around the shaft 75.

The gap adjuster screw 83 loosely engaging the slot 72*e* may be tightened or loosened to adjust the position of the finger tab 72*d* around the shaft 75, which allows for fine tuning of the gap Δg between the distal end of the finger 72 and the fuser belt 51. That is, loosening the screw 83 causes the finger tab 72*d* to rotate away from the stay 74 (i.e., counterclockwise in FIG. 8) around the shaft 75 to reduce the finger-to-belt gap Δg, whereas tightening the screw 83 causes the finger tab 72*d* to rotate toward the stay 74 (i.e., clockwise in FIG. 8) around the shaft 75 to enlarge the finger-to-belt gap Δg.

Although the embodiment above describes the gap adjustment of the non-contact stripper finger 72, a similar gap adjustment mechanism is also provided to the pneumatic stripper nozzle 71 to adjust the width of the spacing or gap Δg between the distal end of the stripping member 71 and the fuser belt 51.

Provision of the gap adjuster mechanism allows for optimizing the distance or relative positions between the fuser belt 51 and the distal end of the pneumatic nozzle 71 defining the outlet opening 71*b* for discharging compressed gas, as well as between the fuser belt 51 and the distal end of the finger 72 defining the stripper edge 72*b*. In the present embodiment, for example, an optimal spacing or gap Δg between the distal end of each stripping member and the fuser belt 51 falls within approximately 1.0 millimeter.

Figure 9:
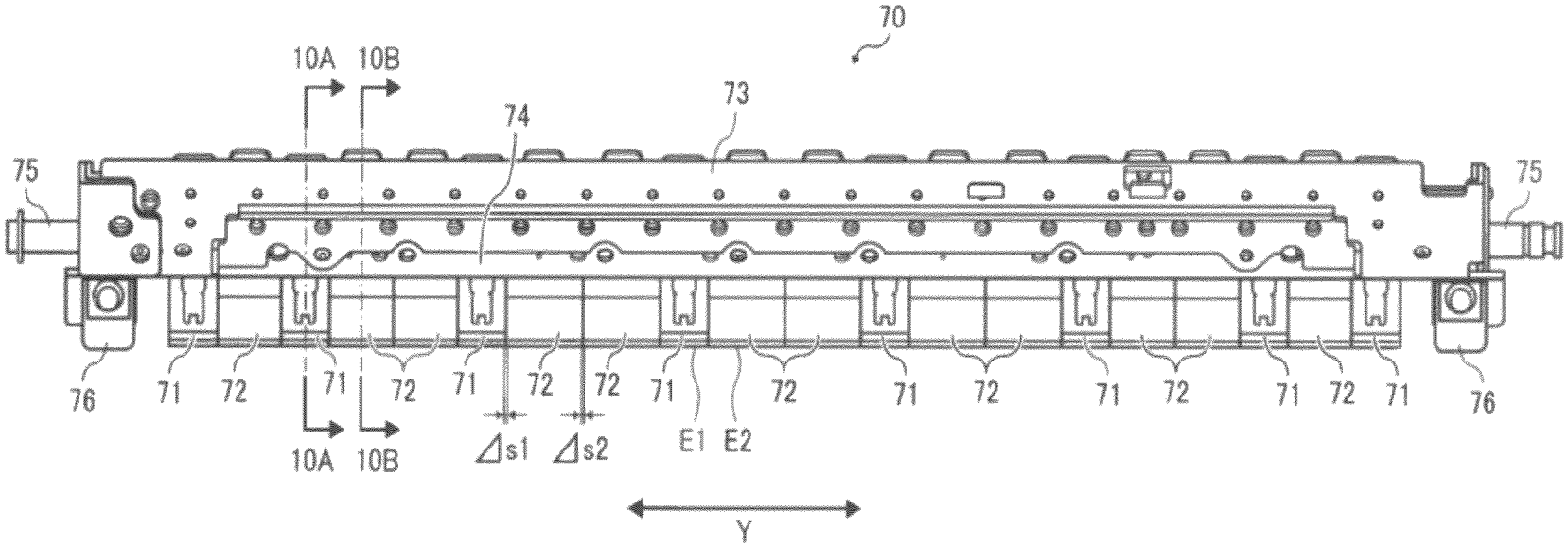
FIG. 9 is a plan view of the media stripper mechanism according to one or more embodiments of this patent specification.

FIG. 9 is a plan view of the sheet stripper mechanism 70 according to one or more embodiments of this patent specification.

As shown in FIG. 9, and as mentioned earlier, the sheet stripper mechanism 70 includes a shaft 75 extending in the axial direction thereof Y parallel to the rotational axis of the rotary, fuser member 51; one or more first stripping members 71, each being a pneumatic nozzle that has a proximal end thereof supported on the shaft 75, and a distal, free end opposite the proximal end thereof pointing toward the fuser member 51 to direct compressed gas toward the nip N along the fuser member 51 for stripping the recording sheet S from the fuser member 51; and one or more second stripping members 72, each being a non-contact finger that has a proximal end thereof supported on the shaft 75, and a distal, free end opposite the proximal end thereof pointing toward the fuser member 51 to assist in stripping the recording sheet S from the fuser member 51 without contacting the fuser member 51.

Figure 10A:
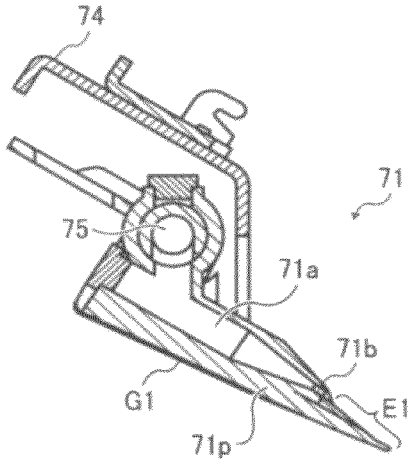
FIGS. 10A and 10B are cross-sectional views taken along lines 10A-10A and 10B-10B, respectively, of FIG. 9.
Figure 10B:
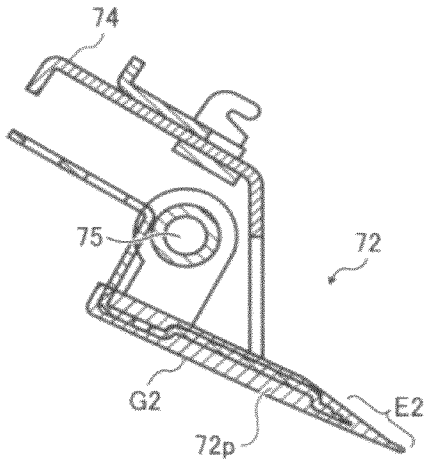

With additional reference to FIGS. 10A and 10B, which are cross-sectional views taken along lines 10A-10A and 10B-10B, respectively, of FIG. 9, the nozzle 71 and the finger 72 are shown with their distal ends E1 and E2, respectively, being coincident with each other in shape and position when viewed in the axial direction Y of the shaft 75. That is, the nozzle 71 and the finger 72 are dimensioned and positioned relative to each other on the single stay 74 via the shaft 75, so that their distal ends E1 and E2 are aligned in the shaft axial direction Y, while having substantially identical cross-sections taken perpendicular to the shaft axial direction Y.

The term "distal end" as used herein refers to a portion of the stripping member at which the stripping member may come into contact with a recording medium being stripped off the rotary member during operation, which extends from an interior point of the stripping member and terminates at the edge of the stripping member. In the present embodiment, for example, the distal end E1 of the nozzle 71 is defined as a portion that extends from the outlet opening 71*b* of the tapered channel 71*a* to the edge of the base 71*p*, and the distal end E2 of the finger 72 is defined as that which corresponds to, or coincides with, the distal end E1 of the nozzle 71.

Further, in the present embodiment, the nozzle 71 and the finger 72 define flat, guide surfaces G1 and G2 at their bottom sides (i.e., the sides of the base members 71*p* and 72*p* that face the sheet conveyance path upon installation) which extend flush with each other from their respective proximal ends to their respective distal ends to guide the recording sheet S stripped off the fuser belt 51.

Furthermore, the multiple stripping members are positioned parallel with and adjacent to each other, such that a distance between each two adjacent stripping members, that is, the width of spacing Δs1 between the nozzle 71 and the finger 72, or the width of spacing Δs2 between two adjacent fingers 72, in the axial direction Y of the shaft 75 falls within approximately 1.5 mm, and preferably, within approximately 1.0 mm.

In such a configuration, the sheet stripper mechanism 70 according to this patent specification can effectively prevent image defects due to interference with the stripping member and the recording medium downstream from the fixing nip N defined between the pair of rotary, fixing members in the fixing device 50.

The inventors have recognized that using a combination of pneumatic and mechanical stripping members to strip a recording medium from a rotary member can result in image defects where the recording medium interferes with the pneumatic nozzle or stripping finger. This is particularly true where the recording medium has a relatively dense toner image printed thereon, which, when processed through the fixing nip, tends to adhere to the fixing member to hinder smooth separation of the recording medium from the fixing member, resulting in the recording medium sliding against the stripping member during conveyance downstream from the fixing nip.

Not surprisingly, such interference between the recording medium and the stripping member results in concomitant image defects where the recording sheet is forced against the stripping member to smear or otherwise damage the toner image printed thereon. The image defects are pronounced where the recording medium is rubbed against an irregular, uneven surface formed by discrete pieces of the media stripper mechanism, which exerts an uneven, concentrated pressure on the recording medium to cause scratches and partial loss of gloss on the resulting image.

The problem is typical of, if not unique to, a configuration where the pneumatic stripper is activated only temporarily during separation of the recording sheet from the fuser member (such as, for example, in a power-efficient design employing a compact air compressor for generating compressed gas), since in such cases, the recording medium exhibits a greater tendency to wrap around the fuser belt than that exhibited in the presence of compressed air constantly supplied throughout processing through the fixing nip.

To address those and other problems encountered during separation of a recording medium from a rotary fixing member, the sheet stripper mechanism 70 according to this patent specification has a combination of pneumatic nozzles 71 and non-contact fingers 72 with their respective distal ends E1 and E2, opposite the proximal ends supported on the shaft 75, being coincident with each other in shape and position when viewed in the axial direction Y of the shaft 75.

With the coincident distal ends E1 and E2 of the stripping members 70 and 71 which together form a substantially smooth, uniform surface facing the sheet conveyance path to prevent concentration of pressure exerted on the recording medium sliding against the stripping members, the sheet stripper mechanism 70 can effectively prevent image defects due to interference between the recording medium and the stripping member, which allows for good imaging performance of the fixing device 50 employing the combination of the pneumatic nozzle and the non-contact finger for stripping the recording medium downstream from the fixing nip N.

Such effects of providing the stripping members 70 and 71 with the coincident distal ends E1 and E2 may be enhanced by providing the stripping members 71 and 72 with the flush guide surfaces G1 and G2 which extend flush with each other from their respective proximal ends to their respective distal ends to smoothly guide the recording medium. Further protection against concentration of pressure exerted on the recording medium may be obtained by reducing the distance Δs between the adjoining stripping members to within approximately 1.5 mm, and preferably, within approximately 1.0 mm.

Experiments were conducted to investigate the effects of the distance Δs between adjoining stripping members on susceptibility to image defects due to interference between the recording medium and the stripping member.

In the experiments, a fixing device was prepared including a fuser belt equipped with a sheet stripper mechanism, similar to those depicted in FIG. 2. Printing was performed on various types of paper different in density or weight per unit area, including normal copy paper weighing approximately 70 g/m$^2$. Two test assemblies were prepared with different configurations of the sheet stripper mechanism: Sample T1 with a distance Δs between adjoining stripping members of 1.5 mm, and Sample T2 with a distance Δs between adjoining stripping members of 2.0 mm.

Visual inspection was conducted to evaluate image quality of the resulting prints. Print quality was classified into five categories A, B, C, D, and E based on the presence and degree of image defects, in particular, smearing and rub-off, as follows:

A: No defects observed

B: Smearing noticeable only when examined carefully against light

C: Smearing observed

D: Significant smearing observed

E: Significant toner rub-off observed causing vertical lines

Of the five categories depicted above, the preceding two indicate that the print is of good quality and acceptable for practical applications.

Figure 11:
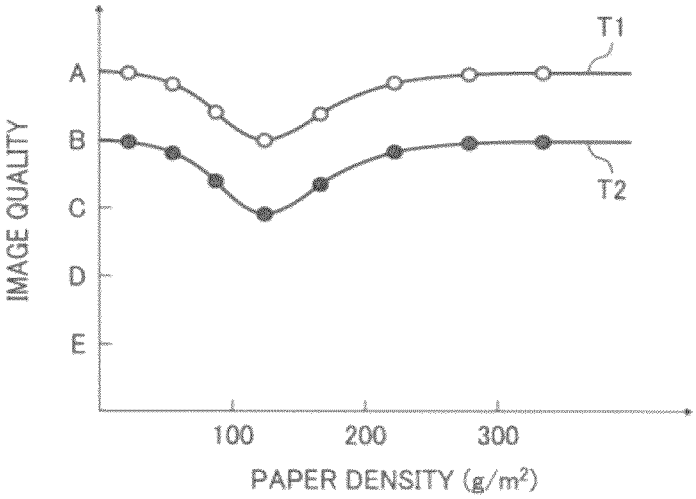
FIG. 11 is a graph showing results of experiments conducted using the media stripper mechanism.

FIG. 11 provides graphs showing results of the visual inspection, "T1" for the sample with the 1.5-mm interspacing distance, and "T2" for the sample with the 2.0-mm interspacing distance, in which the quality of the resulting print is plotted against the density of paper in grams per square meter.

As shown in FIG. 11, in general, the sample T1 with the 1.5-mm interspacing distance yields higher immunity against image defects and therefore better imaging quality than the sample T2 with the 2.0-mm interspacing distance.

Specifically, the quality rating for the sample T1 did not fall below the category B throughout the entire range of paper densities used, indicating good acceptability of 1.5-mm interspaced stripping members for practical applications. The quality rating for the sample T2, on the other hand, remained between the categories B and C and never exceeded the category B. In particular, with the test assembly T2, printing on sheets of paper having densities around 120 g/m$^2$ caused smearing due to interference between the recording medium and the sheet stripping member, which negatively affects practicability of the sheet stripper mechanism.

In the experiments, papers that have smaller or greater paper densities are less susceptible to image smearing than those with moderate paper densities, i.e., around 120 g/m$^2$. Such greater immunity against image smearing of these types of paper is explained by the fact that a heavier, thicker paper sheet can maintain its substantially flat, straight configuration to exit the fixing nip without winding around the fuser member, and hence does not interfere with the sheet stripper mechanism downstream from the fixing nip, whereas a lighter, thinner paper sheet, although more likely to bend and touch surrounding structure during conveyance, does not excessively rub against adjoining surfaces of the sheet stripper mechanism downstream from the fixing nip owing to high flexibility of paper material.

The experimental results above demonstrate that provision of the sheet stripper mechanism with a distance Δs between adjoining stripping members of not exceeding 1.5 mm, and preferably, 1.0 mm, as in the embodiments depicted above, effectively prevents image defects due to interference between the recording medium and the stripping member during conveyance through the fixing process.

To recapitulate, the sheet stripper mechanism 70 according to this patent specification can effectively prevent image defects due to interference between the recording medium and the stripping member, owing to the provision of the coincident distal ends of the stripping members, as well as the flush guide surfaces of the stripping members, and the minimized distance between the adjoining stripping members, which prevents concentration of pressure exerted on the recording medium sliding against the stripping members. Incorporation of the sheet stripper mechanism 70 allows for good imaging performance of the fixing device 50 employing the combination of the pneumatic nozzle and the non-contact finger for stripping the recording medium downstream from the fixing nip N.

Although in several embodiments depicted above, the media stripper mechanism is depicted with specific configurations of the pneumatic nozzle and the non-contact finger, the media stripper mechanism according to this patent specification may be configured otherwise than specifically described herein.

For example, the media stripper mechanism may be provided with any number of pneumatic nozzles and non-contact fingers which may be arranged in any suitable order depending on application-specific requirements. Support and positioning structures, such as a shaft and a gap adjuster mechanism associated with the media stripper mechanism, may also be configured otherwise than specifically described herein.

Further, although in several embodiments depicted above, the fixing device is configured as a belt-based assembly including an endless, rotary fuser belt paired with a rotary pressure roller, the media stripper mechanism according to this patent specification may be applicable to any type of fixing device that includes a pair of rotary fuser and pressure members disposed opposite to each other to form a fixing nip therebetween.

For example, instead of internally heating the cylindrical fixing member, a heater positioned outside the fixing member, such as an electromagnetic induction heater, may be used to heat the fixing device. Also, instead of an endless, looped fuser belt, a heat roller paired with a pressure roller may be used to form a fixing nip.

Furthermore, although in several embodiments depicted above, the image forming apparatus is configured as a tandem color printer that employs four imaging stations arranged sequentially along an intermediate transfer belt, alternatively, instead, the media stripper mechanism according to this patent specification may be applicable to any type of imaging system that incorporates a fixing capability to fix a toner image in place on a recording medium conveyed thorough a fixing nip.

For example, the printer section may employ any number of imaging stations or primary colors associated therewith, e.g., a full-color process with three primary colors, a bi-color process with two primary colors, or a monochrome process with a single primary color. The printer section may include any suitable transfer process, either direct or non-direct, for transferring a toner image from an imaging surface to a recording medium. Also, the image forming apparatus according to this patent specification may be applicable to any type of electrophotographic imaging systems, such as photocopiers, printers, facsimiles, and multifunctional machines incorporating several of such imaging functions.

Numerous additional modifications and variations are possible in light of the above teachings. It is therefore to be understood that, within the scope of the appended claims, the disclosure of this patent specification may be practiced otherwise than as specifically described herein.

What is claimed is:

1. A media stripper mechanism for use with a pair of opposed rotary members disposed opposite each other to form a nip therebetween through which a recording medium is conveyed as the rotary members rotate together, the mechanism comprising:

a shaft extending in an axial direction thereof parallel to a rotational axis of the rotary member;

one or more first stripping members, each being a pneumatic nozzle that has a proximal end thereof supported on the shaft, and a distal, free end opposite the proximal end thereof pointing toward the rotary member to direct compressed gas toward the nip along the rotary member for stripping the recording medium from the rotary member; and one or more second stripping members, each being a non-contact finger that has a proximal end thereof supported on the shaft, and a distal, free end opposite the proximal end thereof pointing toward the rotary member to assist in stripping the recording medium from the rotary member without contacting the rotary member, the distal ends of the nozzle and the finger being coincident with each other in shape and position when viewed in the axial direction of the shaft.

2. The media stripper mechanism according to claim 1, wherein the nozzle and the finger define guide surfaces that extend flush with each other from their respective proximal ends to their respective distal ends to guide the recording medium stripped off the rotary member.

3. The media stripper mechanism according to claim 1, wherein the nozzle and the finger are parallel with and adjacent to each other, such that a distance between the nozzle and the finger in the axial direction of the shaft falls within approximately 1.5 millimeters.

4. The media stripper mechanism according to claim 1, wherein the nozzle and the finger are parallel with and adjacent to each other, such that a distance between the nozzle and the finger in the axial direction of the shaft falls within approximately 1.0 millimeter.

5. The media stripper mechanism according to claim 1, wherein at least two of the fingers are parallel with and adjacent to each other, such that a distance between adjoining fingers in the axial direction of the shaft falls within approximately 1.5 millimeters.

6. The media stripper mechanism according to claim 1, wherein at least two of the fingers are parallel with and adjacent to each other, such that a distance between adjoining fingers in the axial direction of the shaft falls within approximately 1.0 millimeter.

7. The media stripper mechanism according to claim 1, further comprising:

a gap adjustment mechanism provided to each stripping member to adjust a gap between the distal end of the stripping member and the rotary member.

8. The media stripper mechanism according to claim 1, further comprising:

an elongated stay connected to the shaft to support the first and second stripping members in position relative to the rotary member; and a flange disposed at opposed ends of the stay to contact the rotary member outboard of a width of the recording medium, so as to maintain a gap between the distal end of each stripping member and the rotary member.

9. The media stripper mechanism according to claim 8, further comprising:

a spring-loaded, gap adjuster screw connecting each stripping member to the elongated stay to adjust the gap between the distal end of the stripping member and the rotary member.

10. The media stripper mechanism according to claim 1, wherein a gap between the distal end of each stripping member and the rotary member falls within approximately 1.0 millimeter.

11. The media stripper mechanism according to claim 1, wherein the distal ends of the first and second stripping members are of an identical material.

12. The media stripper mechanism according to claim 1, wherein the distal ends of the first and second stripping members comprise injection-molded pieces of fluorine resin.

13. The media stripper mechanism according to claim 1, wherein the distal ends of the first and second stripping members are coated with fluorine resin.

14. The media stripper mechanism according to claim 1, wherein the shaft comprises a hollow, elongated tube defining a duct through which compressed gas is supplied to the pneumatic nozzle supported thereon.

15. The media stripper mechanism according to claim 1, wherein the pneumatic nozzle includes:

a base member defining a surface that faces a media conveyance path;

a tubular, mounting sleeve on the base member, through which the shaft is inserted; and a nozzle body on the base member, defining a generally tapered channel with an outlet opening at its narrower end for discharging compressed gas to outside, and an inlet opening at its wider end for introducing compressed gas into the channel.

16. The media stripper mechanism according to claim 1, wherein the non-contact finger includes:

a base member defining a surface that faces a media conveyance path;

a pair of parallel mounting tabs extending from the base member, each tab defining a slot through which the shaft is inserted; and a separator edge at a distal, free end of the base member for directing a recording medium to position in the media conveyance path.

17. A fixing device, comprising:

a pair of opposed rotary fixing members disposed opposite each other to form a fixing nip therebetween through which a recording medium is conveyed as the rotary members rotate together; and a media stripper mechanism disposed downstream from the fixing nip to strip the recording medium exiting the fixing nip, the mechanism including:

a shaft extending in an axial direction thereof parallel to a rotational axis of the rotary member;

one or more first stripping members, each being a pneumatic nozzle that has a proximal end thereof supported on the shaft, and a distal, free end opposite the proximal end thereof pointing toward the rotary member to direct compressed gas toward the nip along the rotary member for stripping the recording medium from the rotary member; and one or more second stripping members, each being a non-contact finger that has a proximal end thereof supported on the shaft, and a distal, free end opposite the proximal end thereof pointing toward the rotary member to assist in stripping the recording medium from the rotary member without contacting the rotary member, the distal ends of the nozzle and the finger being coincident with each other in shape and position when viewed in the axial direction of the shaft.

18. An image forming apparatus comprising:

a pair of opposed rotary members disposed opposite each other to form a nip therebetween through which a recording medium is conveyed as the rotary members rotate together;

a shaft extending in an axial direction thereof parallel to a rotational axis of the rotary member;

one or more first stripping members, each being a pneumatic nozzle that has a proximal end thereof supported on the shaft, and a distal, free end opposite the proximal end thereof pointing toward the rotary member to direct compressed gas toward the nip along the rotary member for stripping the recording medium from the rotary member; and one or more second stripping members, each being a non-contact finger that has a proximal end thereof supported on the shaft, and a distal, free end opposite the proximal end thereof pointing toward the rotary member to assist in stripping the recording medium from the rotary member without contacting the rotary member, the distal ends of the nozzle and the finger being coincident with each other in shape and position when viewed in the axial direction of the shaft.

* * * * *